United States Patent [19]

Moreno

[11] 4,127,293

[45] Nov. 28, 1978

[54] PANIC LATCH FOR A GRATE

[76] Inventor: Victor Moreno, 31253 San Andreas Dr., Union City, Calif. 94587

[21] Appl. No.: 825,249

[22] Filed: Aug. 17, 1977

[51] Int. Cl.[2] ..... E05C 5/04

[52] U.S. Cl. ..... 292/251

[58] Field of Search ..... 292/251, 37; 85/33; 49/56, 57, 63, 67

[56] References Cited

U.S. PATENT DOCUMENTS

| | | | |
|---|---|---|---|
| 1,475,907 | 11/1923 | Volman | 85/33 |
| 2,209,495 | 7/1940 | Scholfield | 85/33 |
| 3,921,334 | 11/1975 | Black, Sr. | 292/192 X |

FOREIGN PATENT DOCUMENTS

| | | | |
|---|---|---|---|
| 72,788 | 11/1947 | Norway | 85/33 |

*Primary Examiner*—Richard E. Moore
*Attorney, Agent, or Firm*—Bruce & McCoy

[57] ABSTRACT

A panic latch for a grate or other covering for a window or other opening in a building which securely fastens the grate over the opening, yet immediately releases when acted upon by a person inside the building who desires to exit through the opening.

12 Claims, 6 Drawing Figures

PANIC LATCH FOR A GRATE

BACKGROUND OF THE INVENTION

1. FIELD OF THE INVENTION

The present invention relates to panic latches and more particularly to a panic latch for a grate or other covering for a window or opening in a building which is not normally used as a door.

2. DESCRIPTION OF THE PRIOR ART

There are many types of panic latches that are used to lock doors that are not normally used as entrances or exits. Such doors include fire exits and other doors which are normally locked closed to prevent entry from outside but must stand ready to permit quick exit. As the name implies, the doors must be able to be opened quickly, easily, and without confusion when one or more persons try to exit through them in a hurry. All such hardware used for this purpose is called "panic hardware" and is a class of goods characterized by the ability to actuate it very quickly with minimum force and without delay.

In this time of increasing burglary rates, many persons and companies desire to place wrought iron grates or other impenetrable screens over windows and other openings in buildings which are not normally used as entrances and exits in order to prevent intrusion by unauthorized persons. While this is an excellent solution to the problems of preventing intrusion, it also prevents exit through those openings in the event of fire or other emergency which prevents the use of the doors. Because of the risk of people being trapped behind such barriers, the fire codes now prevent the use of such barriers over such windows unless there is an internal release or panic latch which permits the barrier to be swung open for easy and immediate exit through the opening. Prior to the present invention there has been no such panic hardware, and this has prevented people from utilizing the desired grates and screens over their windows. There is an increasing need for such protection, and therefore there is an increasing need for the present invention.

SUMMARY OF THE INVENTION

The present invention is a panic latch for a grate or other converting for an opening enclosed by structure. It comprises a male member secured to the grate and having a free end formed for projecting through the structure adjacent to the opening. A split ring is provided which has mating halves which are formed for engaging the free end of the male member when the halves are disposed in mating relation therearound. The split ring, when engagably disposed on the opposite side of said structure from said grate, prevents the male member from being withdrawn from its projection through the structure. A means is provided, which is actuatable by a person inside the structure, for causing the split ring to separate and release the male member, whereby the male member may be withdrawn through the structure to permit the grate to swing open.

OBJECTS OF THE INVENTION

It is therefore an important object of the present invention to provide a panic latch for a grate or other covering for an opening enclosed by a structure, which securely fastens the grate over the opening, yet immediately releases when acted upon by a person inside the building who desires to exit through the opening.

It is another object of the present invention to provide a panic latch for a grate or other covering for an opening enclosed by a structure, which securely fastens the grate over the opening to prevent intrusion through the opening, and which cannot be actuated from outside of the building.

It is a further object of the present invention to provide a panic latch for a grate which has an actuation mechanism on the inside of the building which can be disguised so it cannot be easily seen from outside of the building.

And it is yet another object of the present invention to provide a panic latch for a grate or other covering for an opening in a building, which, when actuated by a person inside the building who desires to exit through the opening, causes the grate to partially swing open as a result of the actuation of the panic latch.

Further objects of the present invention will become apparent from the description of the preferred embodiment of the invention when it is considered in conjunction with the accompanying drawings.

DESCRIPTION OF THE PREFERRED EMBODIMENT

Figure 1:
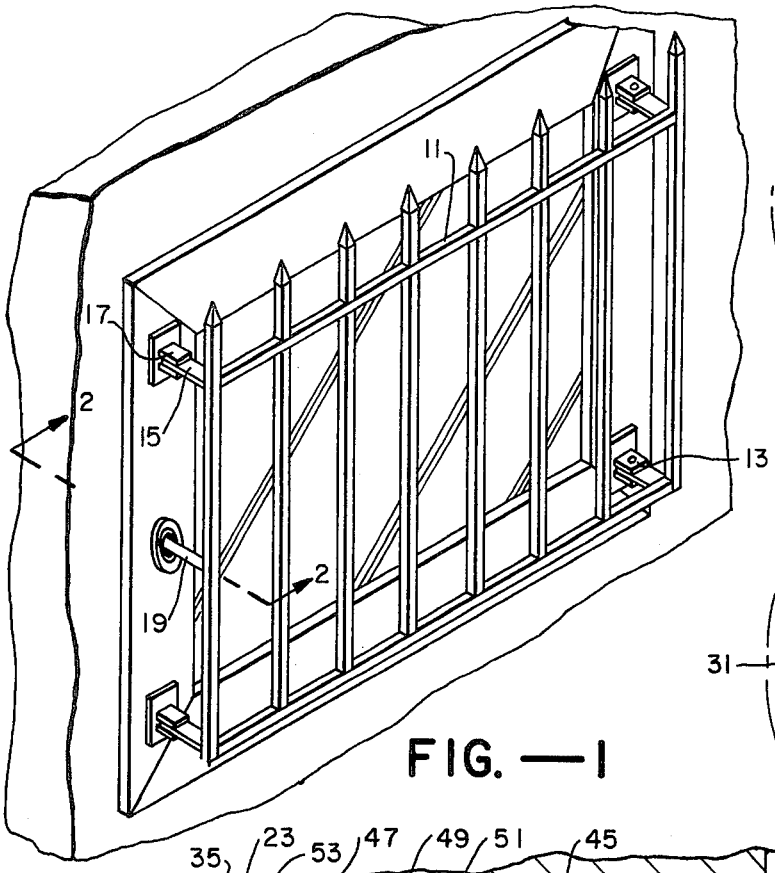
FIG. 1 is a perspective view of a grate employing the present invention.
Figure 4:
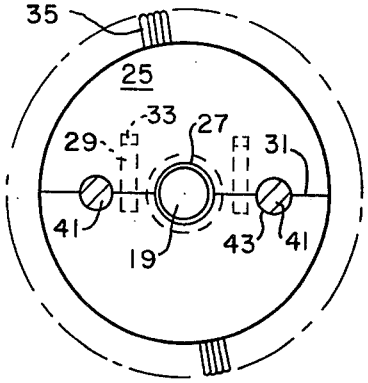
FIG. 4 is a partial section in front elevation of the present invention taken along lines 4—4 of FIG. 2.
Figure 5:
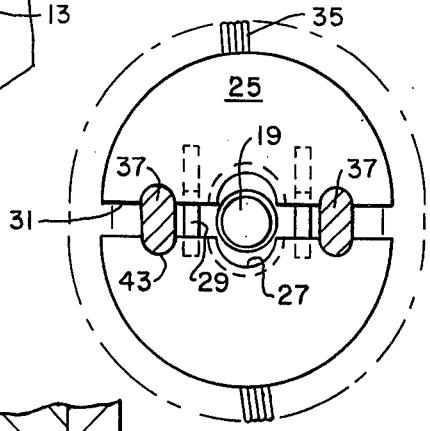
FIG. 5 is also a partial section in front elevation of the present invention taken along lines 5—5 of FIG. 3.
Figure 2:
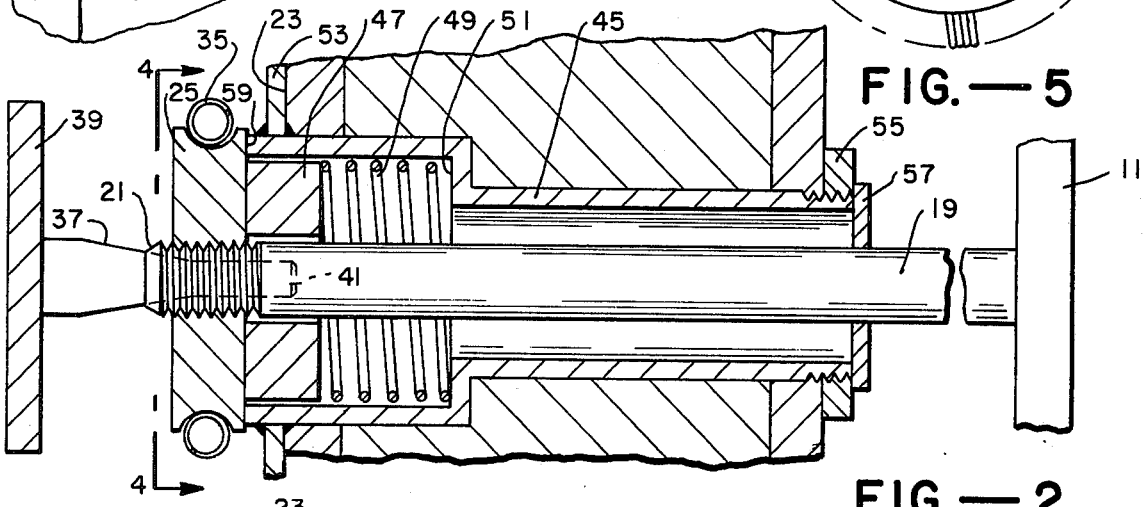
FIG. 2 is a side elevation section taken along lines 2—2 of FIG. 1 and showing the present invention securing the grate against the building in readiness for actuation.
Figure 3:
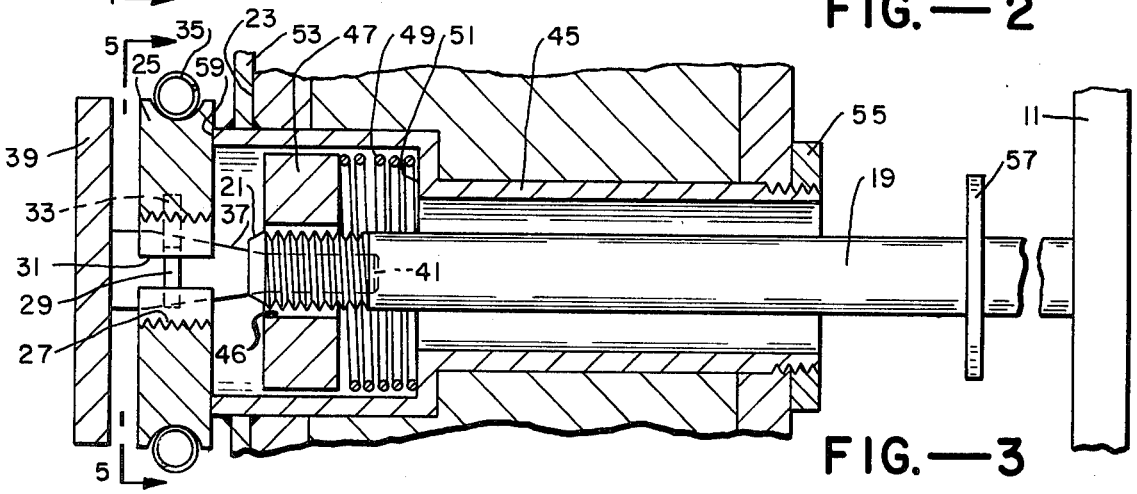
FIG. 3 is a side elevation section taken along lines 2—2 of FIG. 1 and showing the present invention immediately upon actuation of the striker plate to release the grate from its position over the opening.
Figure 6:
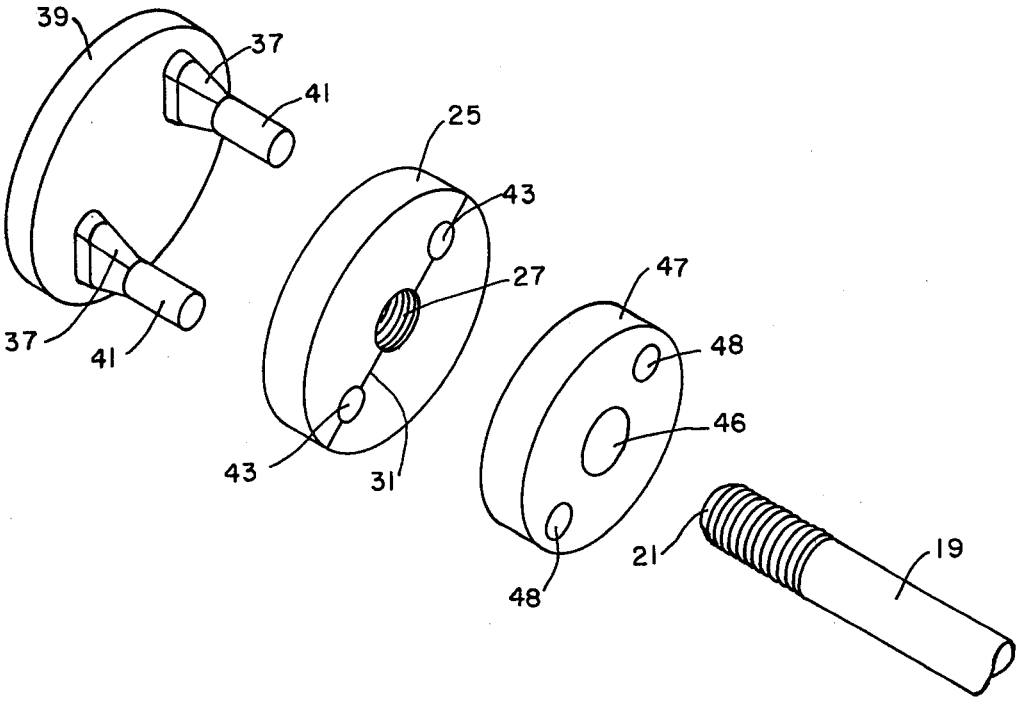
FIG. 6 is an exploded perspective view of the striker plate assembly of the present invention.

The present invention is a panic latch for a grate or other covering for an opening, such as a window or unused door, enclosed by a structure such as a building. A typical such grate, as adapted for the present invention, is shown in FIG. 1 hereof. Usually the grates are bolted directly to the structure at the four corners and possibly at additional mounting points. In the present invention, the grate 11 is hinged 13 at one edge, whereby it can swing open in a horizontal direction around a vertical pivot axis, so that a person trying to exit through the opening does not have to lift the weight of the grate.

The present invention utilizes stabilizing projections 15 which are provided at the opposite ends of the grate, and which engage with female receptacles 17 to secure and position the grate with respect to the opening. The receptacles can be arranged to provide a pressure connection for gripping the stabilizing projections to reduce the stress on the hinges, but the pressure should be light enough that the connection does not prevent easy opening of the grate by pushing on it from inside the building structure.

The panic latch includes a male member 19 which is secured to the grate and has a free end 21 formed for projecting through the structure adjacent to the opening. The free end of the male member is threaded and is of a length to extend beyond the internal wall surface 23 inside the building structure. In its simplest form, this male member is simply a rod which is welded to the grate structure and is of a diameter which permits running a die upon the rod to cut the threads of the desired size. Of course, the rod could be made thicker for that portion which is exposed outside of the building to prevent it from being easily cut through by a hack saw or other tool.

A split ring 25 is provided which has mating halves that are formed for engaging the free end of the male member when the halves are disposed in mating relation therearound. The split ring is of a size that when it is disposed around the male member on the opposite side of the wall of the building from the grate, the split ring prevents the male member from being withdrawn from its projection through the wall. The hole 27 in the split ring is threaded such that the free end of the male member and the split ring can be threadably engaged.

The split ring halves include means to guide the halves to separate and close together in a predetermined relation. This means includes guide pins 29, which extend from the interface 31 of one of the split ring halves, and guide holes 33 disposed on the opposite interface of the other split ring half. The guide pins fit in the guide holes when the split ring halves are mated and cause the halves to separate straight apart in the same plane when the pins are withdrawn from the holes.

Means are provided to urge the halves of the split ring into engagement around the male member. This means includes the characteristic of allowing the split ring halves to separate when the halves are forced apart by the operation of the latch. This means could include an elastic band formed to encircle the periphery of the split ring halves, but in the preferred embodiment an annular coiled spring 35 is used.

A means is provided, which is actuatable by a person inside the structure, for causing the split ring to separate and release the male member, whereby the male member may be withdrawn through the structure to permit the grate to swing open. This means for separating the split ring halves includes at least one wedge shaped member 37 disposed such that it will penetrate between the halves of the split ring and force the two halves apart and thereby cause the split ring to release its engagement with the male member. This occurs when a force is applied to the wedge shaped member to drive it between the split ring halves. In the preferred embodiment, the means for separating the split ring halves includes a pair of interconnected wedges 37 formed for penetrating between the interface of the split ring halves. These wedges are interconnected by a striker plate 39.

Each of the wedge shaped members is provided with a projecting guide 41 which passes though one of a pair of channels 43 which are formed in the mating faces of the split ring halves and are disposed equal distances on opposite sides of the center hole 27 of the split ring. These projecting guides hold the wedge shaped members in alignment with respect to the split ring when it is engaged with the projecting rod, such that the wedge shaped members will penetrate between the split ring halves at the interface and force the split rings halves apart to release their engagement with the rod.

A means is disposed in the building structure which prevents the rod with the split ring attached to it from being withdrawn through the building structure, and yet will allow the rod to be withdrawn when not encumbered by the split ring. In the preferred embodiment, this means is a cylindrical housing 45 having a larger internal diameter at one end than the internal diameter at the other end. The larger end is disposed on the inside of the wall.

A stabilizing ring 47 is provided which includes two holes 48 formed to engage the projecting guides of the wedge shaped members and a central hole 46 through which the rod passes. In operative position, it is disposed in the housing and surrounds the rod on the opposite side of the split ring from the striker plate. The projecting guides 41 of the wedge shaped members are long enough to extend through and beyond the split ring to penetrate into the holes in the stabilizing ring when the panic latch is in the locked condition.

A coil spring 49 is disposed in the housing for urging the stabilizing ring towards the split ring. This spring is supported by the shoulder 51 formed by the diameter change within the housing; the spring being of a diameter to ride on the shoulder created at the change of diameters in the housing.

In the preferred embodiment, the housing of the panic latch has a flange 53 which engages the inside wall of the building structure. The outside end of the housing is threaded and engaged by a threaded nut 55 which securely positions the housing within the structure. A seal such as a rubber washer 57 can be slipped on the projecting rod to seal the exterior end of the housing from the elements.

In operation the grate 11 is closed over the window and the projecting rod 19 projects through the housing within the building wall. The split ring 25 halves are closed together and the wedges 37, interconnected by the striker plate 39, are pushed through the two guide holes 43 in the split ring. The stabilizing ring 47 is then placed against the back of the split ring 25 on the opposite side from the striker plate to form an assembly of three members: the striker plate and wedges, the split ring, and the stabilizing ring. The spring 49 is then inserted into the housing around the rod 19. Next, the assembly is aligned on the rod with the rod member penetrating through the center of the stabilizing ring and engaging the hole 27 of the split ring. The assembly is then rotated so as to screw the split ring onto the rod until the split ring bears tightly against the inner annular edges 59 of the housing. This process draws the rod up tight through the housing until the grate is drawn against the outside of the building. At this point the invention is in operative position holding the grate against the building.

To actuate the panic latch, the striker plate 39 is hit by the heel of the hand and pushed towards the wall 23. This drives the wedges 37 between the split ring halves causing them to separate. The ramped portions of the wedges then bottom out against the smaller diameter of the holes 48 in the stabilizing ring 47 and drive it inward against the spring 49. The striker plate 39 hits the end 21 of the projecting rod and drives it out of the housing. The contact between the surface of the split ring and the striker plate stops the penetrating action of the striker plate after it has struck the projecting rod.

Thus, the action of hitting the striker plate operates to separate the split ring and release the rod, and then drive the rod in such a manner so to push open the grate. The person having actuated the panic latch then may open the window or screen and push open the grate. There is no chance that the restraining rod will come back into the housing and reengage itself and lock in place. Once the wedges have been driven through the split ring, it remains open until it is disassembled and reassembled. The assembly of the striker plate, the split ring, and the stabilizing ring all remain together, and in fact, after the projecting rod has been driven out of the hole, they are not there for the rod to return and reengage with because the restraining spring in the housing pushes those three elements back out of the housing and they fall to the floor and are no longer in the housing.

It will be seen from the foregoing description of the preferred embodiment of the invention that it will perform all the objects attributable thereto. While it has been described in considerable detail, it is not to be limited to such details except as may be necessitated by the appended claims.

I claim:

1. A panic latch for a grate or other covering for an opening enclosed by a structure, comprising a male member secured to the grate and having a free end formed for projecting through said structure adjacent to the opening, a split ring having mating halves which are formed with a means for engaging the free end of said male member when disposed in mating relation therearound, said split ring, when disposed in mating relation with said male member on the opposite side of said structure from said grate, preventing said male member from being withdrawn from its projection through said structure, and means actuatable by a person inside said structure for causing the split ring to separate and release the male member, whereby said male member may be withdrawn through said structure to permit said grate to swing open.

2. The panic latch of claim 1 wherein said means for separating the split ring halves includes at least one wedge-shaped member disposed such that it will penetrate between the halves of the split ring, and cause said split ring to release its engagement with the male member when a force is applied to the wedge-shaped member to drive it between the halves.

3. The panic latch of claim 2 wherein said means for separating the split ring halves includes a pair of interconnected wedges formed for penetrating between the mating interface of the split ring halves.

4. The panic latch of claim 3 wherein said wedges are interconnected by a striker plate.

5. The panic latch of claim 4 wherein the hole in the split ring and the free end of the male member are engagably threaded, and means are included to urge the halves of the split ring into engagement around the male member, said means allowing the split ring halves to separate when said halves are forced apart by force applied to the striker plate.

6. A panic latch for a grate or other covering for a window or other opening in a building which securely fastens the grate over said opening, yet immediately releases when acted upon by a person inside a building who desires to exit through the opening, comprising a rod secured to the grate and having a threaded free end projecting through the building structure adjacent to said opening, a split ring having two mating halves and a threaded center hole, said split ring halves being joinable together around the threaded portion of the rod to threadably engage said split ring with said rod, means for urging the halves of the split ring into engagement around the rod, said means allowing the split ring halves to separate and release the rod when said halves are forced apart, means disposed in the building structure that will prevent the rod with the split ring attached from being withdrawn through the building structure, yet will allow the rod to be withdrawn when not encumbered by the split ring, and a pair of wedge-shaped members interconnected by a striker plate and formed for penetrating between the mating interfaces of said split ring halves.

7. The panic latch of claim 6 wherein the split ring halves are urged to engage the rod by an elastic band formed to encircle the periphery of the split ring halves.

8. The panic latch of claim 7 wherein means are provided to align said wedges with respect to said split ring halves, whereby as said wedges are actuated they will be guided between the mating interface of said split ring halves to force the halves apart.

9. The panic latch of claim 8 wherein means for aligning the two wedges includes a pair of parallel channels formed in the mating faces of the split ring halves and disposed equidistant on opposite sides of the center hole, and projecting guides that are disposed on the ends of said wedge-shaped members and which are arranged to be disposed in sliding relation in the pair of parallel channels.

10. The panic latch of claim 9 including means to guide the split ring halves to separate and close together in a predetermined relation.

11. The panic latch of claim 10 including a stabilizing ring which engages the projecting guide ends of said wedge shaped members, and which, in operative position, is disposed in said housing and surrounds said rod on the opposite side of said split ring from said striker plate which interconnects the wedge shaped members, the projecting guide ends of said wedge shaped members being of a length to extend through and beyond said split ring for engaging said stabilizing ring, and means disposed in said housing for urging said stabilizing ring toward said split ring.

12. A panic latch for a grate or other covering for a window or other opening in a building which securely fastens said grate over said opening, yet immediately releases when acted upon by a person inside the building who desires to exit through the opening, comprising a rod secured to the grate and having a threaded free end projecting through the building structure adjacent to said opening, a split ring having two mating halves and a threaded center hole, said split ring halves being joinable together around the threaded portion of the rod to threadably engage said split ring with said rod, an annular spring encircling the periphery of said split ring and uring the halves into engagement around the rod, mating guide pins and holes disposed at the interface of the split ring halves to guide the split ring halves to separate and close together in a predetermined relation, a pair of channels formed in the mating faces of the split ring halves and disposed equidistant on opposite sides of the center hole, a housing disposed in the building structure that will prevent the rod with the split ring attached from being withdrawn through the building structure, yet will allow the rod to be withdrawn when not encumbered by the split ring, a pair of wedge-shaped members interconnected by a striker plate and formed for penetrating between the mating interface of the split ring halves, each of said wedge-shaped members having projecting guides which pass through the channels formed in said split ring halves, a stabilizing ring which contains holes to engage the projecting guides of said wedge-shaped members, and which, in operative position, is disposed in said housing and surrounds said rod on the opposite side of said split ring from the striker plate which interconnects the wedge shaped members, the projecting guides of said wedge shaped members being of a length to extend through and beyond said split ring and penetrate into the holes in said stabilizing ring, and a spring disposed in said housing for urging said stabilizing ring toward said split ring.

* * * * *